United States Patent [19]

Polzin

[11] Patent Number: 5,025,581

[45] Date of Patent: Jun. 25, 1991

[54] DISPLAY HOLDER

[76] Inventor: Ellen C. Polzin, 1216 N. Cross St., Wheaton, Ill. 60187

[21] Appl. No.: 405,729

[22] Filed: Sep. 11, 1989

[51] Int. Cl.[5] ..... G09F 1/10

[52] U.S. Cl. ..... 40/159; 40/156; 40/594

[58] Field of Search ..... 40/159, 593, 594, 156, 40/661, 643, 644, 152, 611

[56] References Cited

U.S. PATENT DOCUMENTS

| | | | |
|---|---|---|---|
| 1,677,277 | 7/1928 | Federbush et al. | 40/661 X |
| 2,093,598 | 9/1937 | Clark | 40/642 |
| 2,152,881 | 4/1939 | Engel . | |
| 2,611,369 | 10/1952 | Herrick | 40/159 |
| 2,925,675 | 2/1960 | Lumpkin | 40/643 |
| 3,071,881 | 1/1963 | Ruterbusch | 40/159.2 |
| 3,893,252 | 7/1975 | Chase | 40/158.1 |
| 3,943,645 | 3/1974 | Viestors | 40/661 |
| 4,090,464 | 5/1978 | Bishopp et al. | 40/594 X |
| 4,184,276 | 1/1980 | Hernandez | 40/593 X |
| 4,305,216 | 12/1981 | Skelton | 40/644 |
| 4,413,434 | 11/1983 | Rupert et al. | 40/159 X |
| 4,622,769 | 11/1984 | Friedman | 40/152.1 |
| 4,637,149 | 1/1987 | Rivkin | 40/594 X |
| 4,771,557 | 9/1988 | Bowman | 40/158.1 |
| 4,900,604 | 2/1990 | Martinez | 40/594 X |

FOREIGN PATENT DOCUMENTS

| | | | |
|---|---|---|---|
| 2299974 | 8/1976 | France | 40/159 |
| 2189216 | 10/1987 | United Kingdom | 40/591 |

OTHER PUBLICATIONS

3M Company—sales literature relating to various labels and the like—12 pages.

*Primary Examiner*—José V. Chen
*Assistant Examiner*—J. Bonifanti
*Attorney, Agent, or Firm*—Gerstman & Ellis, Ltd.

[57] ABSTRACT

A photograph display holder is provided in which a cover with a transparent area for viewing a photograph is temporarily attached to a surface by an adhesive coating made of an impermanent adhesive material affixed to one side of the cover. A containing structure holds a photograph behind the transparent area of the cover while the cover is attached to a surface. An insertion opening allows a photograph to be removed and replaced with another photograph without removing the cover from the surface to which the cover is attached. The adhesive coating is covered by a removable layer of material. The cover is made of a pliable material. A transparent layer covers the transparent area in the cover. A protective layer of material with an adhesive coating made of an impermanent adhesive material affixed to one side of the protective layer is temporarily attached to the transparent layer. The transparent layer being made of a pliable transparent material. The cover is die cut along its outer edges and has ornamental designs placed on it.

5 Claims, 7 Drawing Sheets

DISPLAY HOLDER

FIELD OF THE INVENTION

The present invention concerns a novel display holder that is highly efficient and easy to use.

BACKGROUND OF THE INVENTION

1. Field Of The Invention

The present invention contemplates a photograph display holder in to which an individual photograph may be inserted. An adhesive coating made of an impermanent adhesive material is affixed to the back side of the holder which allows the holder to be repeatedly attached to one surface, removed, and attached to another surface without damaging the holder or the surface to which the holder is attached.

The use of an impermanent adhesive allows the user to use the holder in multiple locations over a period of time. Further, because an impermanent adhesive will not damage the surface to which it is mounted, a user is provided with significant flexibility as to the types of surfaces to which the holder may be attached. A single holder may be attached to a wooden door, plaster wall, metal refrigerator, a paper book, or virtually any other surface. Further, a single holder may be used to display a number of different photographs over a period of time in which the subject matter of the photographs appear along different planes.

A series of photograph display holders can be attached to the pages of a child's book. Photographs in which the subject matter appears along different planes can be easily inserted in to the holders to create a personalized story book for the child. As the child matures, the story can be easily modified to create new stories.

2. Description Of The Prior Art

Photographs are typically exhibited using one of three methods: conventional frames, low cost plastic photograph holders, or photograph albums. The advantages and disadvantages of each of these methods are discussed below.

Conventional Frames

Conventional frames are made from a variety of materials. The main parts of a conventional frame include 1) an outer border usually made of wood, metal or plastic, 2) a transparent layer usually made of glass or plastic and 3) an inexpensive layer of cardboard with a bracing device attached to it. A picture is placed between the transparent layer and the cardboard layer which is then held in place within the outer border with nails or staples. The transparent material has an added benefit of protecting a picture while it is being displayed.

Conventional frames have a number of disadvantages, however. 1) Conventional frames are highly rigid. They can only be used to display pictures in a limited number of ways. Conventional frames can only be mounted to walls using nails or another destructive means, or propped up by a brace and exhibited on a shelf or table. 2) Conventional frames are expensive and inefficient to produce. Many frames have outer boarders made from wood or metal that must be cut and assembled by hand. Other frames use materials, such as plastics, that are specially molded to reduce the manual assembly time, however, current technology limits the cost reduction available using these types of materials.

Low Cost Plastic Photograph Holders

Some manufacturers sell clear plastic photograph holders which are nothing more than a piece of clear plastic bent in the middle with a magnetic device attached to the back of the holder. While plastic holders of this type are inexpensive to produce, there are a number of disadvantages associated with this design, including: 1) the holder is rigid, 2) the holder can only be mounted to a metal surface, and 3) the holder has three open sides (photographs displayed in this type of frame can easily fall out when the frame is mounted sideways).

Photograph Albums

Photograph albums are designed to store a large number of photographs in an orderly manner. Typically, the pages in a photograph album are constructed of thin sheets of plastic that are folded or bonded in such a way that a pocket is formed in to which a photograph is inserted. Numerous pockets are housed in a single album, thereby allowing a user to view photographs by paging through the album as if the user were reading a book. Although this method of storing photographs is inexpensive, it does not provide a means of displaying photographs independent of the album. For example, there is no means of attaching an individual pocket to a wall or other surface.

Another type of photograph album includes plastic pockets formed in a similar manner described above. On the back side of the pocket, an adhesive layer is permanently attached to the pocket. A picture is placed into the pocket and attached to an individual page in an album by means of the adhesive layer. Examples of this type of design include, for example, U.S. Pat. No. 2,152,881 which issued on Apr. 4, 1939 to Albert W. Engel for Transparent Mounting Device; U.S. Pat. No. 2,611,369 which issued to Robert E. Herrick on Sept. 23, 1952 for Album Photo Holder or Mounting; U.S. Pat. No. 3,893,252 which issued to Martson Chase on July 8, 1975 for an Adhesive Picture Mount; and U.S. Pat. No. 4,771,557 which issued on Sept. 20, 1988 to Robert G. Bowman for Transparent Pocket For Mounting Display Items And Method Of Manufacturing Same.

While photograph album pockets with an adhesive coating layered on their back side can be mounted to surfaces other than the intended page of a photograph album, all of the above described transparent pockets lack the ability to be repeatedly attached to one surface, removed at any point in time, and attached to another surface without damaging the pocket or the surface to which the pocket is attached.

In addition, pockets that permanently bond to the surface to which they are attached are limited to only holding photographs taken along a specific plane. For example, a photograph album pocket that holds a photograph in which the subject matter appears along the vertical plane can not be used at a later point in time to display a photograph in which the subject matter appears along the horizontal plane.

Still other disadvantages of these prior art pockets are apparent when they are compared to the present photograph display holder. None of the these prior art pockets can be die cut on more than two of their outer edges without damaging the underlying structure of their design. This substantially limits the ability to offer this type of design in a variety of shapes and sizes.

Still another disadvantage is that none of these prior art pockets provide an inexpensive means of providing a decorative border that overlaps the outer edges of a photograph, or special ornamental designs that enhance the subject matter of the photograph.

It is an object of the present invention to provide a photograph display holder that can be easily attached to a variety of surfaces.

Another object of the present invention is to provide a photograph display holder that can be easily removed from one surface and attached to another surface without damaging the holder or the surface to which the holder is attached.

A further object of the present invention is to provide a photograph display holder that is less expensive to produce than the photograph holders of the prior art.

A still further object of the present invention is to provide a photograph display holder that individuals can easily use to display their personal photographs in a variety of locations.

Another object of the present invention is to provide a photograph display holder that is pliable and can be used to display photographs in children's books.

A further object of the present invention is to provide a photograph display holder that can be easily manufactured in a variety of shapes and sizes.

A still further object of the present invention is to provide a photograph display holder which can be easily manufactured with a variety of decorative borders and ornamental designs.

Other objects and advantages of the present invention will become apparent as the description proceeds.

SUMMARY OF THE INVENTION

In accordance with the preferred embodiment of the present invention, a photographic display holder is provided. The holder includes a cover with a transparent area for viewing a photograph. An adhesive coating made of an impermanent adhesive material is provided which is affixed to one side of the cover for temporarily attaching the cover to a surface. A containing means holds a photograph behind the transparent area of the cover while the cover is attached to a surface.

In the illustrative preferred embodiment, an insertion opening allows a photograph to be removed and replaced with another photograph without removing the cover from the surface to which the cover is attached.

In the illustrative preferred embodiment, the adhesive coating is covered by a removable layer of material. The cover is made of a pliable material. A transparent layer covers the transparent area in the cover. A protective layer of material with an adhesive coating made of an impermanent adhesive material affixed to one side of the protective layer is temporarily attached to the transparent layer. The transparent layer is made of a pliable transparent material. The cover is die cut along its outer edges and has ornamental designs placed on it.

DETAILED DESCRIPTION OF THE ILLUSTRATIVE EMBODIMENT

Figure 1:
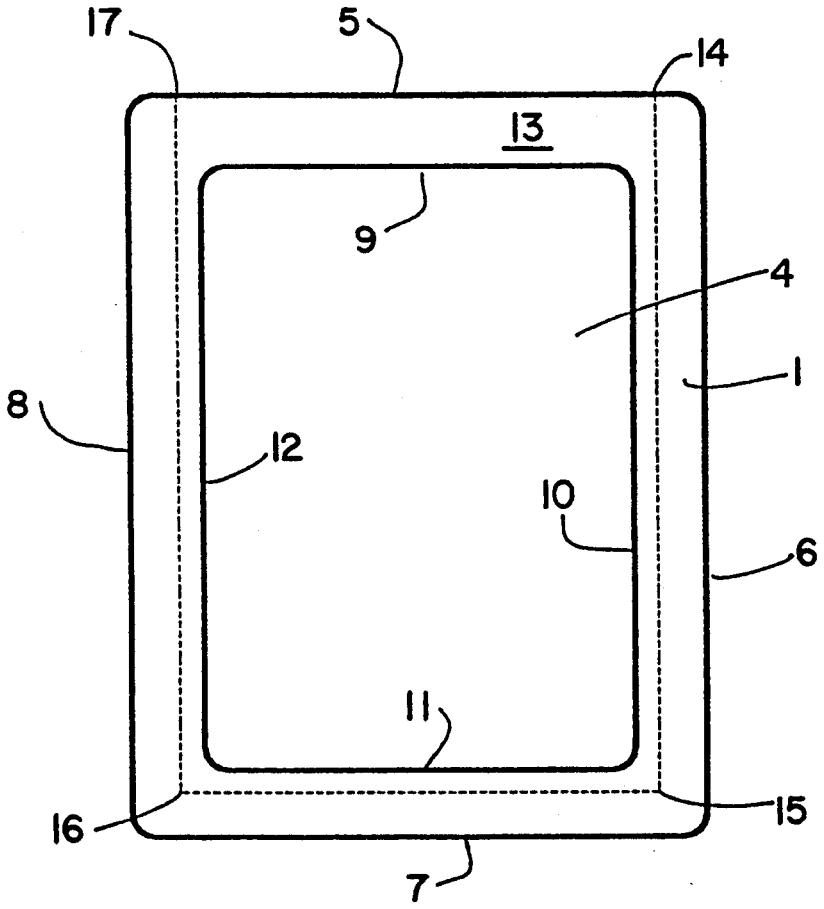
FIG. 1 is a front elevation of a top layer of a photograph display holder constructed in accordance with the principles of the present invention.

Referring to FIG. 1, there is shown therein a top layer 1 having outer edges 5, 6, 7 and 8 and inner edges 9, 10, 11 and 12. Inner edges 9, 10, 11 and 12 define opening 4. Opening 4 is a transparent area for viewing a photograph. Area 13 on the back side of top layer 1 is defined by the dashed lines between alignment points 14, 15, 16 and 17, respectively, and overlaps inner edges 9, 10, 11 and 12. Alignment points 14, 15, 16 and 17 are positioned on the back side of top layer 1 so that the top edge of area 13 is flush with outer edge 5 and an approximately equal distance is provided between outer edges 6, 7 and 8 and the side edges and bottom edge of area 13. The importance of area 13 with alignment points 14, 15, 16 and 17 in the assembly process is discussed below.

Figure 2:
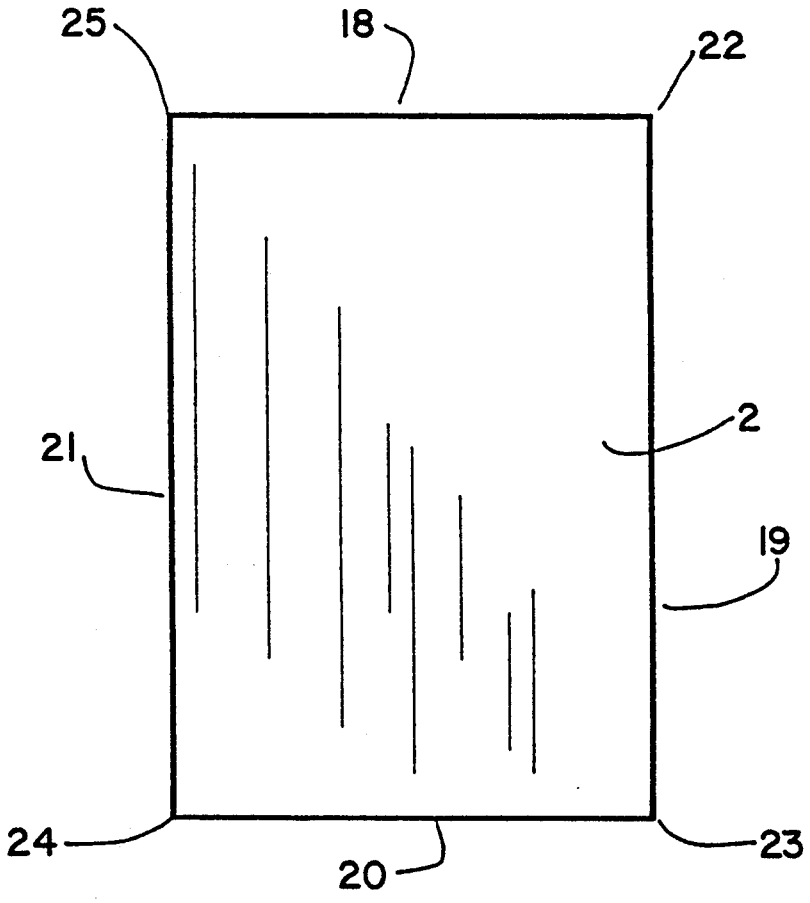
FIG. 2 is a front elevation of a middle layer of the photograph display holder of FIG. 1.

Middle layer 2, as illustrated in FIG. 2, is defined by outer edges 18, 19, 20 and 21. Middle layer 2 is constructed in such a way that it is the same size as area 13 in FIG. 1. Outer edges 18, 19, 20 and 21 are shorter in length than outer edges 5, 6, 7 and 8, respectively, but longer in length than inner edges 9, 10, 11 and 12, respectively, in FIG. 1. Alignment point 22 is located at the intersection of outer edges 18 and 19. Alignment point 23 is located at the intersection of outer edges 19 and 20. Alignment point 24 is located at the intersection of outer edges 20 and 21. Alignment point 25 is located at the intersection of outer edges 21 and 18. Middle layer 2 is made of a transparent material. The importance of points 22, 23, 24 and 25 in the assembly process is discussed below.

Figure 3:
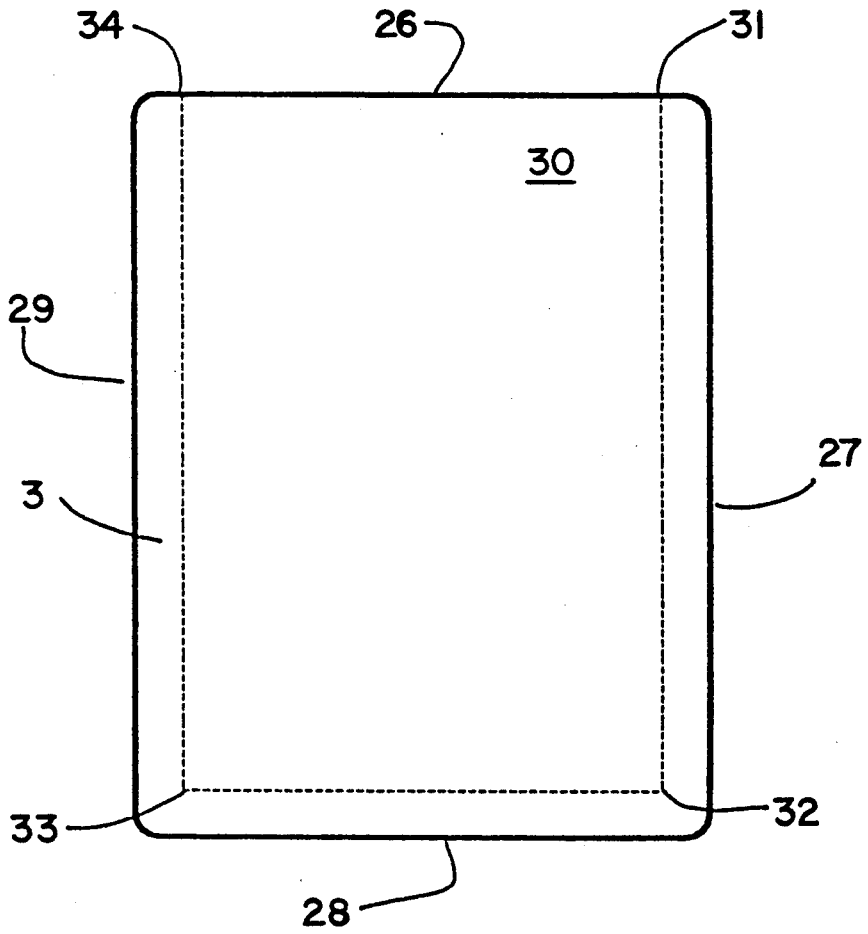
FIG. 3 is a front elevation of a bottom layer of the photograph display holder of FIG. 1.

Bottom layer 3, as illustrated in FIG. 3, is defined by outer edges 26, 27, 28 and 29. Outer edges 26, 27, and 29 are the same length as outer edges 5, 6, 7 and 8, respectively, in FIG. 1. Area 30, on the front side of bottom layer 3, is defined by the dashed lines between alignment points 31, 32, 33 and 34, respectively. Area 30 is the same size as area 13 in FIG. 1. Alignment points 31, 32, 33 and 34 are positioned on the front side of bottom layer 3 in such a way that the top edge of area 30 is flush with outer edge 26 and an approximately equal distance is provided between outer edges 27, 28 and 29 and the side edges and bottom edge of area 30. The importance of area 30 with alignment points 31, 32, 33 and 34 in the assembly process is discussed below.

Figure 4:
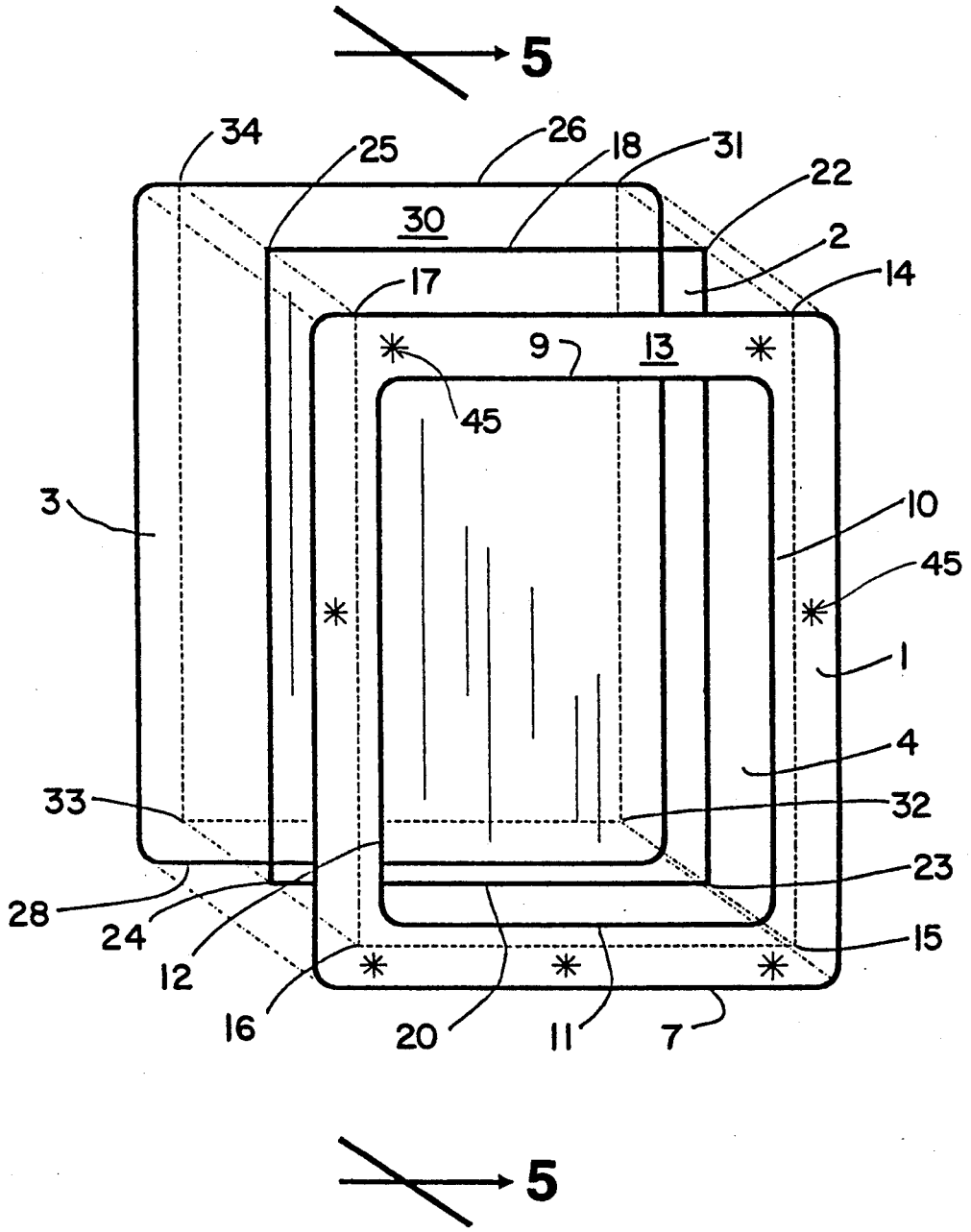
FIG. 4 is an exploded view of the photograph display holder of FIG. 1 showing the relationship of the middle layer to top and bottom layers.
Figure 5:
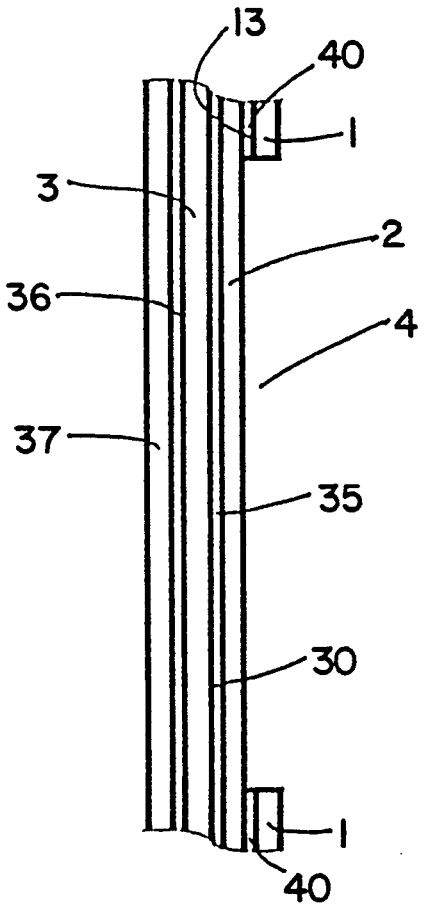
FIG. 5 is a diagrammatic cross-sectional elevation, taken along the plane of the line 5—5 of FIG. 4, and in non-exploded form, showing the various layers.
Figure 6:
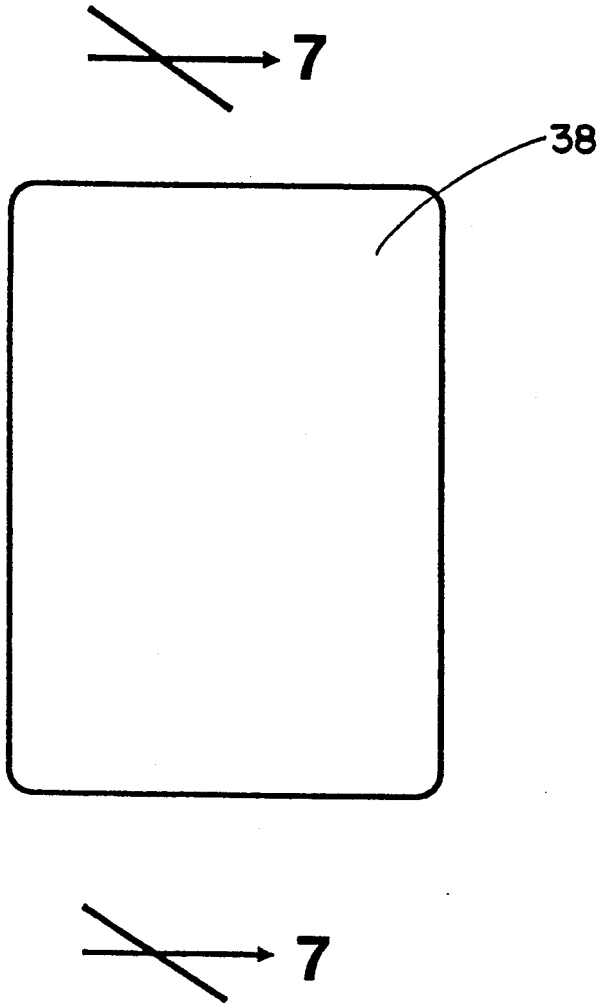
FIG. 6 is a front elevation of a protective layer of the photograph display holder of FIG. 1.
Figure 7:
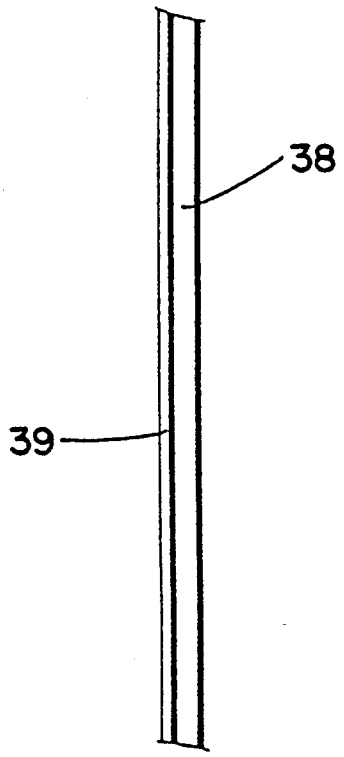
FIG. 7 is a diagrammatic cross-sectional elevation taken along the plane of the line 7—7 of FIG. 6 showing the various layers.

Top layer 1, middle layer 2 and bottom layer 3 are assembled together to make a cover. The relationship of bottom layer 3 and middle layer 2 to top layer 1 in the assembly process is illustrated in FIG. 4. Middle layer 2 with alignment points 22, 23, 24 and 25 is placed over bottom layer 3 so that alignment points 22, 23, 24 and 25 are centered over alignment points 31, 32, 33 and 34 of bottom layer 3, respectively. When properly aligned, middle layer 2 is positioned directly over area 30 of bottom layer 3.

Top layer 1 is placed over middle layer 2 and bottom layer 3 in such a way that alignment points 14, 15, 16 and 17 are centered over alignment points 22, 23, 24 and 25, respectively, of middle layer 2 and alignment points 31, 32, 33 and 34, respectively, of bottom layer 3. When properly aligned, area 13 of top layer 1 is positioned directly over the front side of middle layer 2 and area 30 of bottom layer 3.

An adhesive coating 40 is affixed to the back side of top layer 1. The adhesive coating of top layer 1 bonds to the surface area of bottom layer 3 not covered by middle layer 2. In addition, the adhesive coating of top layer 1 bonds to the surface area of middle layer 2 overlapping inner edges 9, 10, 11 and 12.

When assembled properly, a cavity 35 is created between the back side of middle layer 2 and area 30 of bottom layer 3. An insertion opening is created between outer edge 26 of bottom layer 3 and outer edge 18 of middle layer 2. The cavity is used to contain a photograph behind the transparent area created in the assembly process. The insertion opening is used to insert and remove photographs from the cover.

It is noted that when constructing a cover, it is preferred that the size of opening 4 be smaller than the size of the photograph to be inserted into the cavity. As a result, the edges defining opening 4 will overlap the photograph when the photograph is inserted into the cavity.

Various means for attaching a cover to a surface can be included in the design. For example, a pressure sensitive adhesive coating 36 could be affixed to the back side of bottom layer 3. In this example, the adhesive coating would allow a cover to be attached to a variety of surfaces. It is noted that to prevent multiple covers from adhering to one another during transportation, a removable layer 37 of material would be attached to the adhesive coating that a user would remove by peeling it off prior to attaching the cover to a surface.

When adhesive made of an impermanent material with a low to medium tack is used, the cover can be temporarily attached to one surface, removed at any point in time, and attached to another surface without damaging the cover or the surfaces to which the cover is attached. An example of this type of impermanent adhesive is the adhesive used on the "Post It" note pad product line manufactured by Minnesota Mining and Manufacturing of St. Paul, Minn.

The ability to reposition the holder at any point in time after the holder has initially been attached to a surface provides the user with significant flexibility as to where the holder can be displayed. For example, the holder could be initially attached to a wooden door and displayed there for a period of time. Later, the holder could be removed and attached a metal surface, such as a refrigerator door, and displayed there for a period of time. Finally, the holder could be removed from the metal surface and mounted in a photograph album and stored therein for a period of time. By using an adhesive made of an impermanent material the user can attach a holder to virtually any surface and not be concerned about damaging the surface or the holder.

It is noted that other means can be affixed to the back side of bottom layer 3 to provide a means of attaching a cover to a surface, including a magnet or clipping device. In addition, a bracing means can be affixed to the back side of bottom layer 3 to provide a means of propping up a cover on a shelf or table.

A large variety of different covers can be easily made by simply varying some part of the cover's assembly. For example, when the bottom layer 3 is excluded from the cover assembly, top layer 1 and middle layer 2 form a cover. The adhesive coating on the back side of top layer 1 can be used to hold middle layer 2 in place while attaching the cover to a surface. In this example, when a cover of this design is attached to a surface, a cavity is created between the cover and the surface to which the cover is attached. This cavity is used to contain a photograph behind the transparent area.

Another example relates to varying the length of middle layer 2. When the length of middle layer 2 is increased so that, when assembled, outer edge 20 of middle layer 2 is flush with outer edge 7 of top layer 1 and outer edge 28 of bottom layer 3, a cover is created with two insertion openings.

Still other covers can be created by combining layers, thereby further simplifying the design. For example, top layer 1 and middle layer 2 can be made of a single sheet of transparent material creating a combined layer. In this example, strips of adhesive coating affixed to the outer side areas of the back side of the combined layer would bond the combined layer to bottom layer 3. Because the adhesive coating is limited to the outer side areas of the combined layer, a cavity is created between the combined layer and bottom layer 3 which holds a photograph behind the transparent area of the cover. Further, if the adhesive coating is affixed to at least two, but not more than three, outer side areas, a cover with at least one insertion opening is created when the combined layer is assembled to bottom layer 3.

In this example, if bottom layer 3 is also excluded in the assembly process, the strips of adhesive on the back side of the combined layer could be used to directly attach the cover to a surface. When a cover of this design is attached to a surface, a cavity is created between the cover and the surface to which the cover is attached which holds a photograph behind the transparent area of the cover.

It is noted that some variations to some part of the cover's assembly may create a cover that is more economical or simpler to manufacture. For example, middle layer 2 could be the same size as top layer 1 and bottom layer 3. In this example, strips of adhesive coating could be affixed to the outer side areas of the back side of middle layer 2 which would bond middle layer 2 to bottom layer 3. Because the adhesive coating is limited to the outer side areas of middle layer 2, a cavity is created between middle layer 2 and bottom layer 3 which holds a photograph behind the transparent area of the cover. Top layer 1 could then be placed on the top side of middle layer 2. Because middle layer 2 is the same size as top layer 1 and bottom layer 3, there are no unusual shaped layers that could be difficult to orientate during the assembly process.

By excluding middle layer 2 from the final assembly, another cover is created that is very economical to manufacture. In this example, strips of adhesive coating affixed to the outer side areas of the back side of top layer 1 would bond top layer 1 to bottom layer 3. Because the adhesive coating is limited to the outer side areas of top layer 1, a cavity is created between top layer 1 and bottom layer 3 which holds a photograph behind the transparent area of the cover. Further, if the adhesive coating is affixed to at least two, but not more than three, outer side areas, a cover with at least one insertion opening is created when top layer 1 is assembled to bottom layer 3.

Other variations to the cover assembly may create a cover that is more rugged or less susceptible to damage. For example, a protective layer 38 may be added to the cover assembly which would protect the exposed area of middle layer 2 as defined by opening 4 from being scratched or soiled when the cover is being assembled, shipped or displayed in retail outlets. To provide the most protection to the exposed area of middle layer 2, protective layer 38 should be the same size as opening 4. If the protective layer included an impermanent adhesive coating 39 affixed to its back side, the protective layer could be directly attached to the exposed surface area of middle layer 2. The user could easily remove the protective layer by peeling it off before displaying a photograph.

Still other types of covers can be created by using different types of materials in different combinations when constructing top layer 1, middle layer 2, and bottom layer 3. Top layer 1 and bottom layer 3, for example, can be made of either pliable materials, such as paper or plastic, or solid materials, such as wood, metal or molded plastic. In addition, the materials used to make top layer 1 and bottom layer 3 can be transparent or opaque. When top layer 1 and bottom layer 3 are constructed of an inexpensive pliable opaque material, such as paper, the cost of the photograph display holder is substantially reduced. In addition, when combined with a middle layer 2 that is also made of a pliable transparent material, the assembled photograph display holder can easily bend and conform to a variety of rough or curved surfaces. As a result, a user of photograph display holders constructed of pliable materials could inexpensively display a number of photographs on a variety of surfaces, including wooden doors, paper booklets and plaster walls.

Ornamental designs, including text and borders, can be added to most materials using some type of ornamenting means including printing, screening, etching, or stamping. When top layer 1 is made of paper material, for example, ornamental designs can be easily printed or screened on to the front side of top layer 1. The process of printing ornamental designs on a photograph display holder is very inexpensive and allows for an unlimited number of designs. As a result, a user of can choose from a variety of designs that enhance the composition of a particular photograph or matches the particular decor where the holder will be displayed.

By varying the shapes and sizes of top layer 1, middle layer 2 and bottom layer 3, covers having various shapes and sizes can also be made. In addition, by varying the shape and size of opening 4, still other covers of different designs can be made. After assembling top layer 1 to middle layer 2 and bottom layer 3, for example, the assembly can be die cut, thereby creating an outer edge with ornamental designs such curves or angles. In this example, die cutting the layers after the layers are assembled creates very exact, clean outer edges.

The ability to easily make covers of various shapes and sizes allows, for example, a cover to be made that would hold a photograph of a specific size; or a cover to be made with a special design that enhances photographs with a particular type of subject matter. A cover could be die cut such that it is shaped like a toy teddy bear. A cover in the shape of a toy teddy bear would be suitable for displaying photographs with children as their subject matter.

By varying the size of bottom layer 3 in relation to the size of top layer 1, still other covers of different designs can be made. For example, when top layer 1 is bonded to a bottom layer 3 that is larger than top layer 1, a portion of bottom layer 3 is exposed. Ornamental designs could be added to the exposed portion of bottom layer 3 to create different covers. Ornamental designs 45 may also be carried elsewhere on the holder, as desired.

Although an illustrative embodiment of the invention has been shown and described, it is to be understood that various modifications and substitutions, including shape, size, materials and number of layers, may be made by those skilled in the art without departing from the novel spirit and scope of the present invention.

What is claimed is:

1. An item display holder which comprises:

a base ply formed of a flexible paper-like material and having a top side and an underside;

an upper ply formed of a flexible paper-like material and having a pair of opposed sides overlying the top side of said base ply;

said upper ply comprising a frame defining a cut-out interior area for enabling viewing of the item to be displayed;

means adhering said opposed sides of said upper ply to said top side of said base ply whereby a slot is formed between said opposed sides for insertion of the item to be displayed and for enabling said item to be located in said cut-out area overlying said base ply;

a transparent ply interposed between said upper ply and said base ply and located within said cut-out interior area;

means adhering said upper ply to said transparent ply enabling an item located in said cut-out area to underlie said transparent ply;

an adhesive coating formed of an impermanent adhesive material affixed to the underside of said base ply for temporarily attaching said display holder to a surface and for removing and reattaching said holder to a surface; and a removable layer of material covering said adhesive coating.

2. An item display holder as defined in claim 1, in which said base ply and upper ply are die cut along their outer edges.

3. An item display holder as defined in claim 1, in which ornamental designs are printed upon said upper ply.

4. An item display holder as defined in claim 1, in which said impermanent adhesive material is affixed to substantially the entire underside of said base ply.

5. An item display holder which comprises:

a base ply formed of a flexible paper-like material and having a top side and an underside;

an upper ply formed of a flexible paper-like material and having a pair of opposed sides overlying the top side of said base ply;

said upper ply comprising a frame defining a cut-out interior area for enabling viewing of the item to be displayed;

means adhering said opposed sides of said upper ply to said top side of said base ply whereby a slot is formed between said opposed sides for insertion of the item to be displayed and for enabling said item to be located in said cut-out area overlying said base ply;

a transparent ply interposed between said upper ply and said base ply and located within said cut-out interior area;

means adhering said upper ply to said transparent ply enabling an item located in said cut-out area to underlie said transparent ply;

a removable protective layer of flexible paperlike material overlying said transparent ply for protecting said transparent ply;

an adhesive coating formed of an impermanent adhesive material affixed to the underside of said base ply for temporarily attaching said display holder to a surface and for removing and reattaching said holder to a surface; and a removable layer of material covering said adhesive coating.

* * * * *